US006674340B2

(12) United States Patent
Quan et al.

(10) Patent No.: US 6,674,340 B2
(45) Date of Patent: Jan. 6, 2004

(54) RF MEMS SWITCH LOOP 180° PHASE BIT RADIATOR CIRCUIT

(75) Inventors: Clifton Quan, Arcadia, CA (US); Brian M. Pierce, Moreno Valley, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/121,096

(22) Filed: Apr. 11, 2002

(65) Prior Publication Data

US 2003/0193377 A1 Oct. 16, 2003

(51) Int. Cl.[7] ..... H01P 1/18; H01P 3/08; H01P 9/00

(52) U.S. Cl. ..... 333/164; 333/26; 343/795

(58) Field of Search ..... 333/25, 26, 105, 333/156, 161; 343/795

(56) References Cited

U.S. PATENT DOCUMENTS 4,070,639 A 1/1978 Nemit et al. ..... 333/31
4,800,393 A 1/1989 Edward et al. ..... 343/821
4,825,220 A * 4/1989 Edward et al. ..... 343/795
5,014,022 A 5/1991 Wolfson et al. ..... 333/161
6,377,134 B1 * 4/2002 Takenaka ..... 333/161
6,456,238 B1 * 9/2002 Posey ..... 342/427
6,466,102 B1 * 10/2002 Grant et al. ..... 333/105
6,529,093 B2 * 3/2003 Ma ..... 333/101

* cited by examiner

*Primary Examiner*—Terry D. Cunningham
*Assistant Examiner*—Quan Tra
(74) *Attorney, Agent, or Firm*—Leonard A. Alkov; Glenn H. Lenzen, Jr.

(57) ABSTRACT

A switched loop RF radiator circuit, comprising a radiator element, a RF input/output (I/O) port, and a balun coupled between the radiator element and the (I/O) port. The balun includes a 180° switched loop circuit having transmission line legs coupled to a balun transition to provide a selectable phase shift, and a microelectromechanically machined (MEM) switch Many radiator circuits can be deployed in an electronically scanned antenna array.

20 Claims, 10 Drawing Sheets

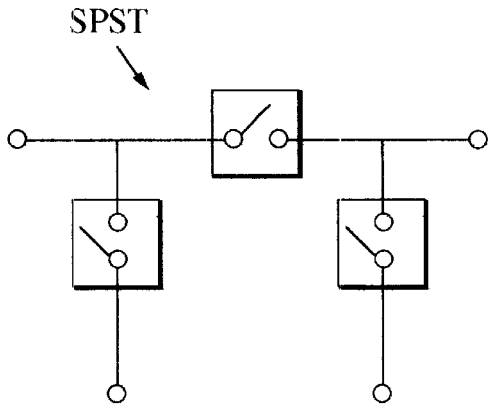
Fig. 4A
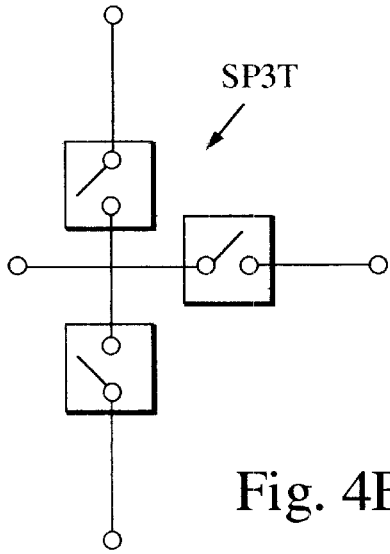
Fig. 4B
Fig. 5
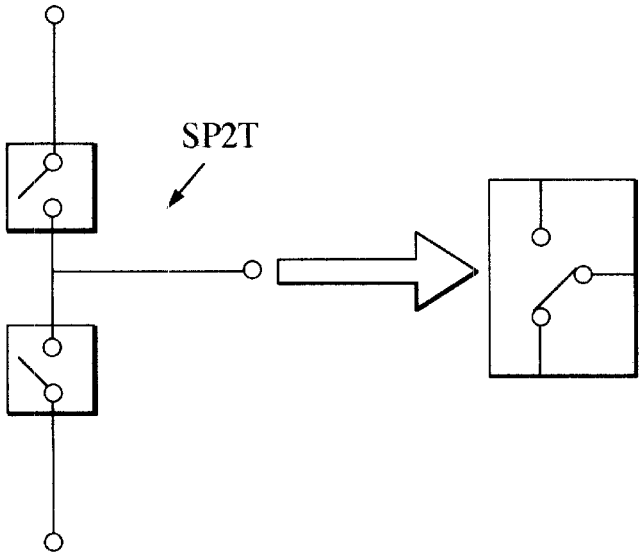

RF MEMS SWITCH LOOP 180° PHASE BIT RADIATOR CIRCUIT

This invention was made with Government support under Contract No. F33615-99-1473 awarded by the Department of the Air Force. The Government has certain rights in this invention.

BACKGROUND OF THE DISCLOSURE

Exemplary applications for this invention include space-based radar systems, situational awareness radars, and weather radars. Space based radar systems will use electronically scan antennas (ESAs) including hundreds of thousands of radiating elements. For each radiating element, there is a phase shifter, e.g. 3 to 5 bits, that, collectively in an array, control the direction of the antenna beam and its sidelobe properties. For ESAs using hundreds of thousands of phase shifters, these circuits must be low cost, be extremely light weight (including package and installation), consume little if no DC power and have low RF losses (say, less than 1 dB). For space sensor applications (radar and communications) these requirements exceed what is provided by known state of the art devices.

Current state of the art devices used for RF phase shifter applications include ferrites, PIN diodes and FET switch devices. These devices are relatively heavy, consume relatively large amounts of DC power and are relatively expensive. The implementation of PIN diodes and FET switches into RF phase shifter circuits is further complicated by the need of additional DC bias circuitry along the RF path. The DC biasing circuit needed by PIN diodes and FET switches limits the phase shifter frequency performance and increase RF losses.

SUMMARY OF THE DISCLOSURE

A switched loop RF radiator circuit is disclosed, comprising a radiator element, a circuit RF input/output (I/O) port, and a balun coupled between the radiator element and the I/O port. The balun includes a 180° switched loop circuit having two transmission line legs coupled to a balun transition to provide a selectable 180° phase shift, and a micro-electromechanically machined (MEM) switch circuit to select one of the transmission line legs.

Many radiator circuits can be deployed in an electronically scanned antenna array.

BRIEF DESCRIPTION OF THE DRAWING

These and other features and advantages of the present invention will become more apparent from the following detailed description of an exemplary embodiment thereof, as illustrated in the accompanying drawings, in which:

FIGS. 4A–4B illustrate in top view diagrammatic views respective switch circuit junctions using MEMS switches.

FIG. 5 is a top diagrammatic view of a circuit module with a single-pole double throw junction from two SPST MEMS switches.

DETAILED DESCRIPTION OF THE DISCLOSURE

The following exemplary embodiments employ MEM metal-metal contact switches. U.S. Pat. No. 6,046,659, the entire contents of which are incorporated herein by this reference, describes a MEM switch suitable for the purpose.

Figure 1A:
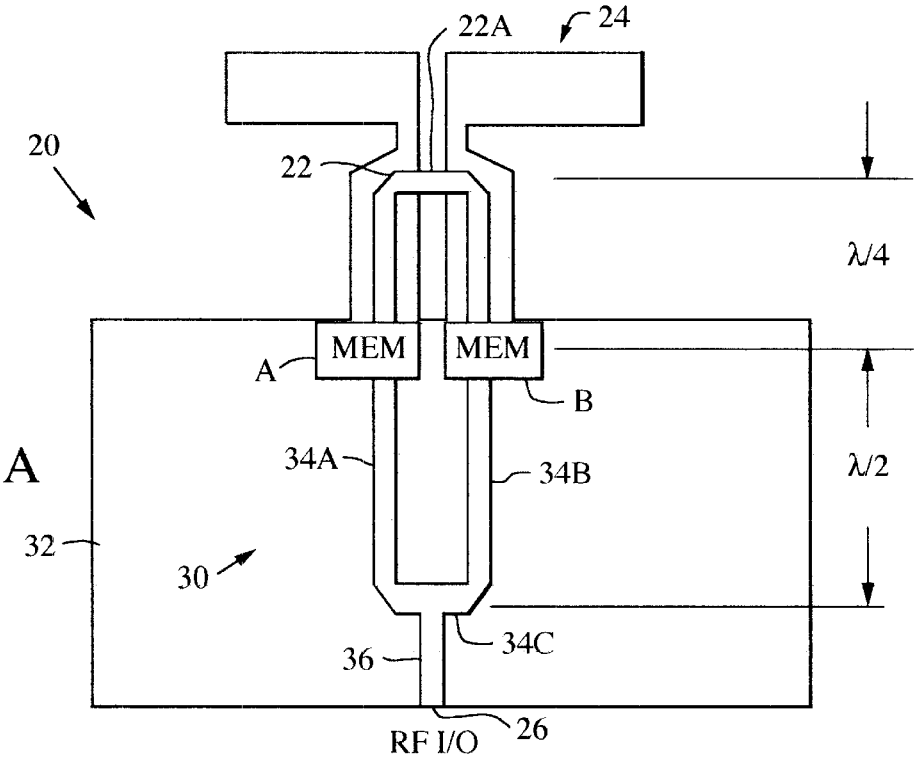
FIG. 1A is a schematic circuit diagram illustrating a MEM switch circuit integrated into a radiator balun to realize 0°/180° phase bit operation.

A new class of switch loop 180° phase bit radiator circuit configurations is described. In one exemplary embodiment, illustrated in FIGS. 1A–5, a switch loop phase bit radiator circuit 20 generates 180° phase shift by rerouting the RF signal around a loop transition or balun 22 by means of two single pole single throw switches (SPST) A and B. The circuit 20 includes a radiating element 24, shown here as a dipole. The circuit RF I/O port 26 is positioned in a microstrip transmission line circuit 30, comprising a dielectric substrate 32 on which microstrip conductor lines are defined, in a manner well known to those skilled in the art. The conductor pattern defines the loop legs 34A and 34B, which join together at junction 34C to conductor portion 36. The effective electrical length between the balun entrance and the MEM switches is ¼λ at a wavelength of interest, e.g. a center frequency in an operating band, as shown in FIG. 1. The effective electrical length between the switches A and B and the joinder 34C of the loop is ½λ.

Figure 1B:
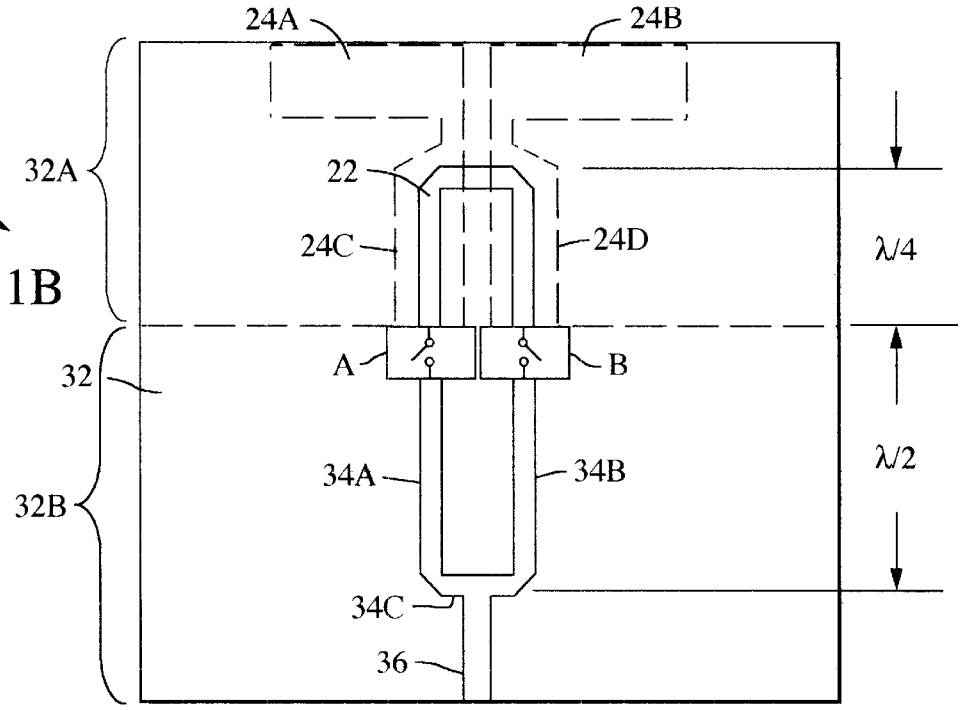
FIG. 1B is a diagrammatic illustration of an exemplary embodiment of the circuit of FIG. 1A.

FIG. 1B shows one exemplary technique for fabrication of the circuit 20. The dipole 24 and the microstrip line 30 are both fabricated on a common dielectric substrate 32. The arms 24A, 24B of the dipole 24 are fabricated as conductor segments on the back surface of the substrate, as indicated by the phantom lines of the arms. The arms 24A, 24B are connected to a slotline transmission line 24E comprising conductor lines 24C, 24D. The back surface of the substrate in region 32A is otherwise free of a conductive layer. In region 32B, the back surface of the substrate is covered with a conductive ground plane layer for the microstrip transmission line 30, to which the conductor lines 24C, 24D connect. On the front surface of the substrate, the MEM switches A and B, the conductor lines forming the balun 22 and the conductor lines 34A, 34B, 36 of the microstrip transmission line 30 are formed. The conductor line patterns can be formed using photolithographic techniques, for example.

Figure 1C:
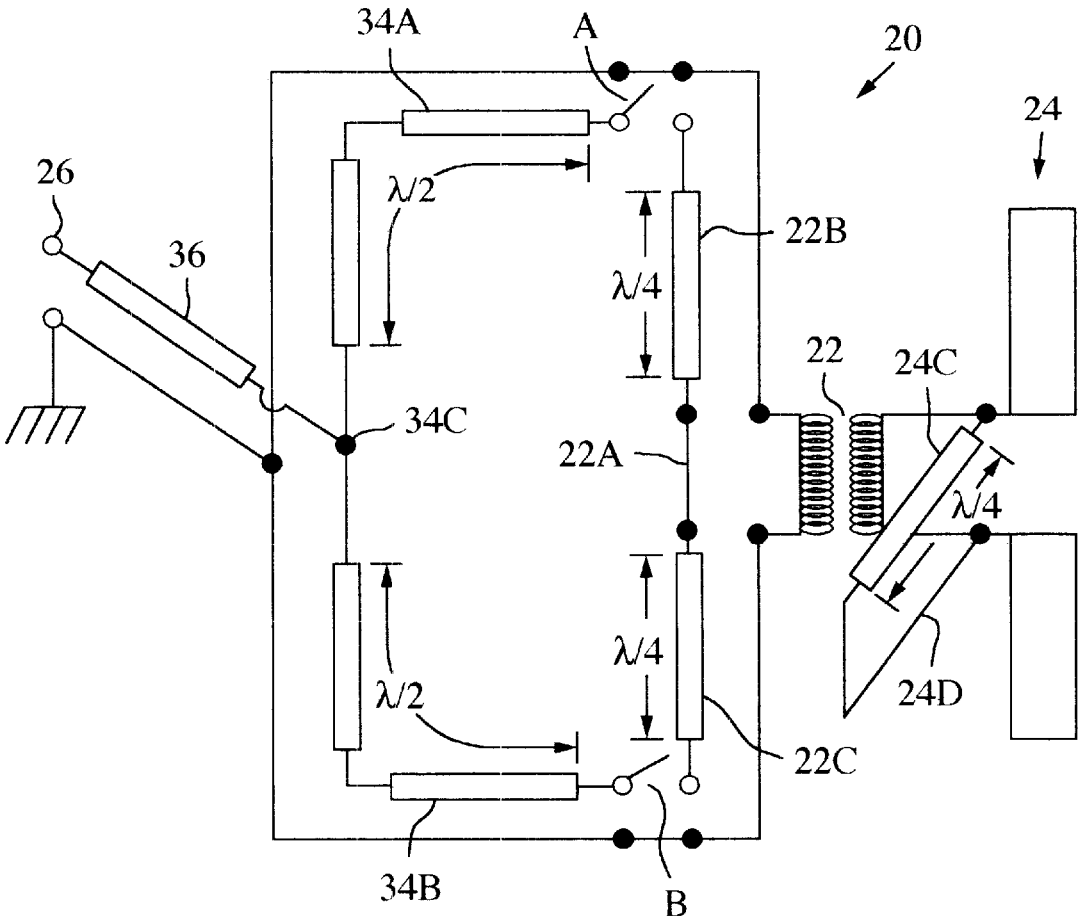
FIG. 1C is an electrical schematic of the circuit.

FIG. 1C is an electrical schematic of the circuit 20. The dipole 24 is coupled to the balun transition 22 through the slotline 24E. The balun transmission line segment 22A connects between quarter wave segments 22B, 22C. The MEM switches A, B are respectfully connected between conductor segments 22B, 34A, and between 22C, 34B. The microstrip conductor segments 34A and 34B join at 34C which is connected to port 26 through conductor segment 36.

Figure 2A:
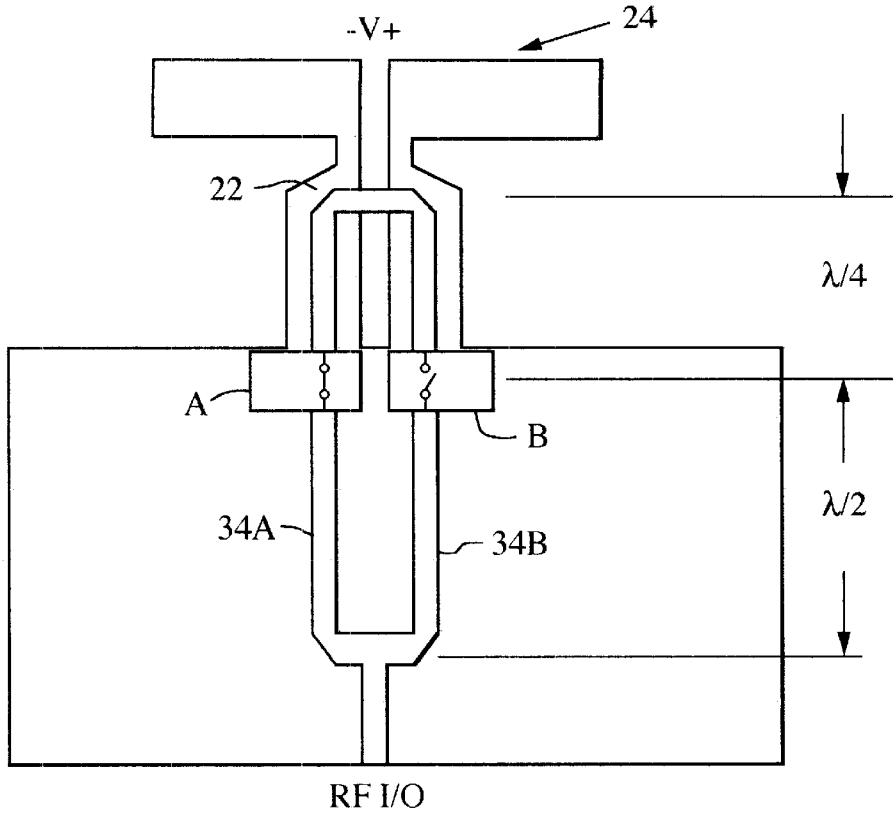
FIGS. 2A–2B are schematic diagrams of the switch circuit of FIG. 1A, illustrating how the circuit generates 180° phase shift by rerouting the RF signal around an loop transition or balun by two MEMS RF switches.
Figure 2B:
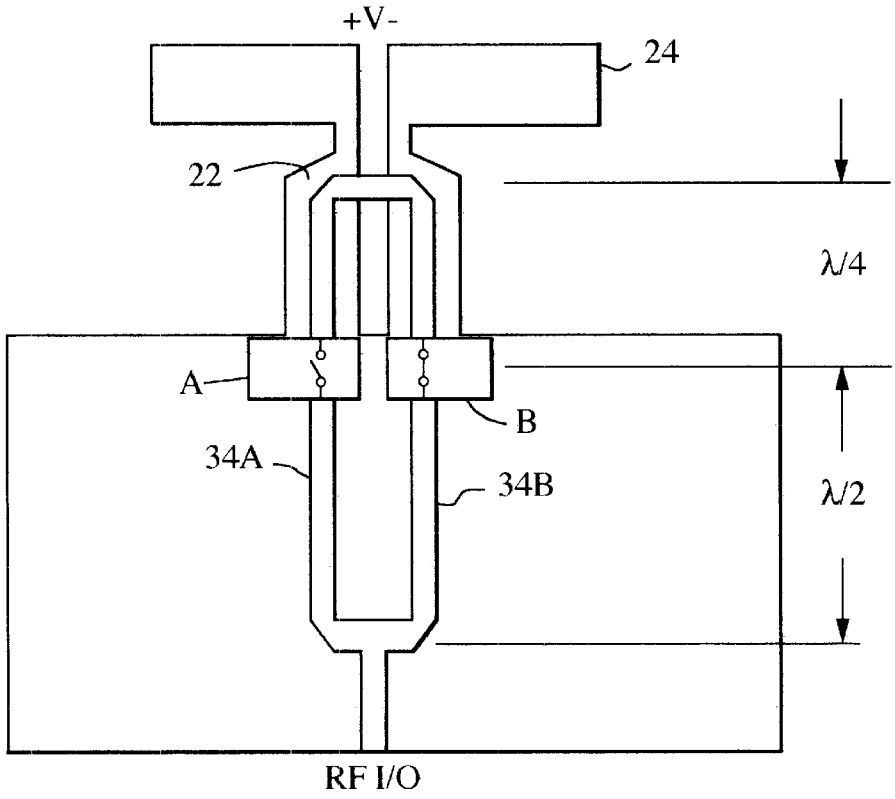

In one phase state of the circuit 20, shown in FIG. 2A, switch A is closed while the other switch B is opened. This switch combination realizes a balun transition that excites a RF voltage potential across the gap between the two arms of the radiator 24. In the other phase state (FIG. 2B), the switch A is opened while the other switch B is closed. This switch combination also realizes a balun transition with the exception that the excited RF voltage potential is 180° out of phase with respect to excited RF voltage of the first state. Unlike PIN diode switches, DC bias used to actuate the metal-metal RF MEMS switches is not coupled to the RF transmission line. Also note that while FIGS. 1A–2B show a dipole radiator, this invention can be applied to other antenna array elements such as flared notch radiators, flared dipole radiators, spiral antenna, and stacked patch radiators.

Figure 3:
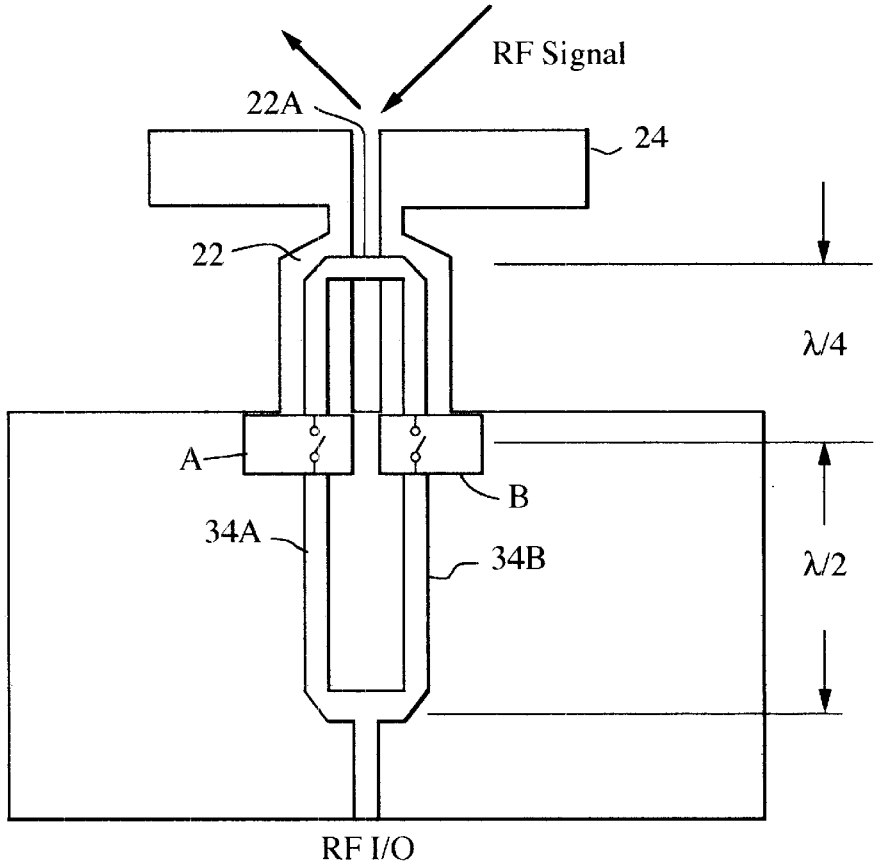
FIG. 3 illustrates the circuit of FIG. 1 with both MEMS RF switches in the open circuit condition to prevent RF energy from entering the radiator element.

When the switches A, B are used behind the radiating elements in an antenna array, the switch loop 180° phase bit radiator circuit will also function as a reflective shutter by setting both MEMS switches to open circuit states, as schematically depicted in FIG. 3. As energy of an external RF signal enters the radiator, the open circuited switches A, B appeared as short circuits (due to the quarter wavelength spacing) at the balun transition 22A. The external RF signal is then reflected back out the radiator.

As described in commonly assigned application Ser. No. 09/607,604, the low capacitance of the metal-metal contact switch in the open state results in low parasitics at the switch junctions, as well as high isolation. Low parasitics make it possible for multiple metal-metal contact switches to share a common junction in parallel, i.e., the low parasitics enable the realization of MEMS single-pole multi-thrown switch junctions. These "junctions" can be realized in hybrid circuit configurations or integrated as a single MMIC chip, as illustrated in FIGS. 4A–4B. FIG. 4A illustrates three MEM switches connected to form a "single-pole 2-throw" ("SP2T") junction. FIG. 4B shows three MEM switches connected to form a "single-pole 3-throw" ("SP3T") junction. FIG. 5 shows a SP2T junction which is a combination of two MEM switch SPST devices on a single MMIC. The DC control lines for the switch junctions in these visualizations are not shown, and pass through vias.

Figure 6:
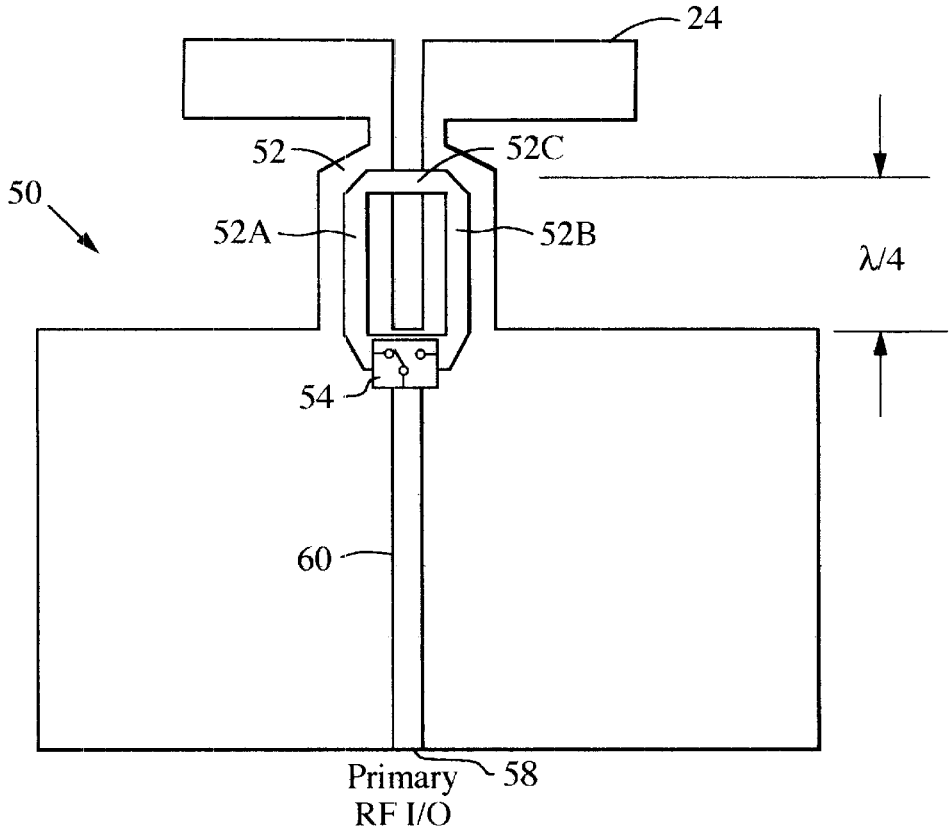
FIG. 6 is a diagrammatic schematic view of an alternate embodiment of a MEM switch circuit integrated into a radiator balun to realize 0°/180° phase bit operation.

The bandwidth of one exemplary embodiment of the circuit 20 of FIGS. 1A–3 is 25% at X-band because of the half wave length of transmission lines that separate the MEMS switches from the common junction 34C near the input of the circuit. Near octave bandwidth can be achieved in an alternate embodiment by replacing the two MEMS SPST switches A, B and half wave length long transmission lines 34A, 34B with a single device including a MEMS SP2T RF switch circuit as shown in FIG. 5. An exemplary embodiment of such a circuit 50 is shown in FIG. 6. The radiating element 24 is coupled to the primary RF I/O port 58 by the balun 52, MEMS RF SP2T switch 54 and microstrip line 60. The balun 52 comprises a microstrip loop with microstrip conductor legs 52A, 52B joined adjacent the radiator by transition segment 52C. The two legs are connected to the respective output ports of the switch 54. The input port of the switch 54 is connected to the microstrip conductor 60 leading to the I/O port 58. The balun 52 has an effective electrical length of ¼λ in this embodiment. Since the MEMSRF SP2T switch 54 comprises two MEMS series SPST RF switches in the circuit configuration of FIG. 5 in this exemplary embodiment, both output ports of the SP2T device can be set to open circuit states together or separately. Thus the new switch loop circuit in FIG. 6 has the same functionality as the one shown in FIG. 1 but with wider bandwidth.

The exemplary switch loop 180° phase bit radiator circuit shown in FIG. 6 employs quarter wave transformers (provided by the microstrip legs 52A, 52B) to provide matching into the balun. Typically, matching into a balun involves a design that utilizes the impedance level of both the microstrip transmission line and slotline in addition to their transmission line length which is often close but not exactly quarter-wave. This is because of the different effective dielectric constants associated with the strip transmission line and slotline. Often one encounters the physical inconvenience of the slotline length being longer than the strip transmission line in the initial design stage requiring some impedance optimization. For octave band performance, the impact is minimal.

Figure 7:
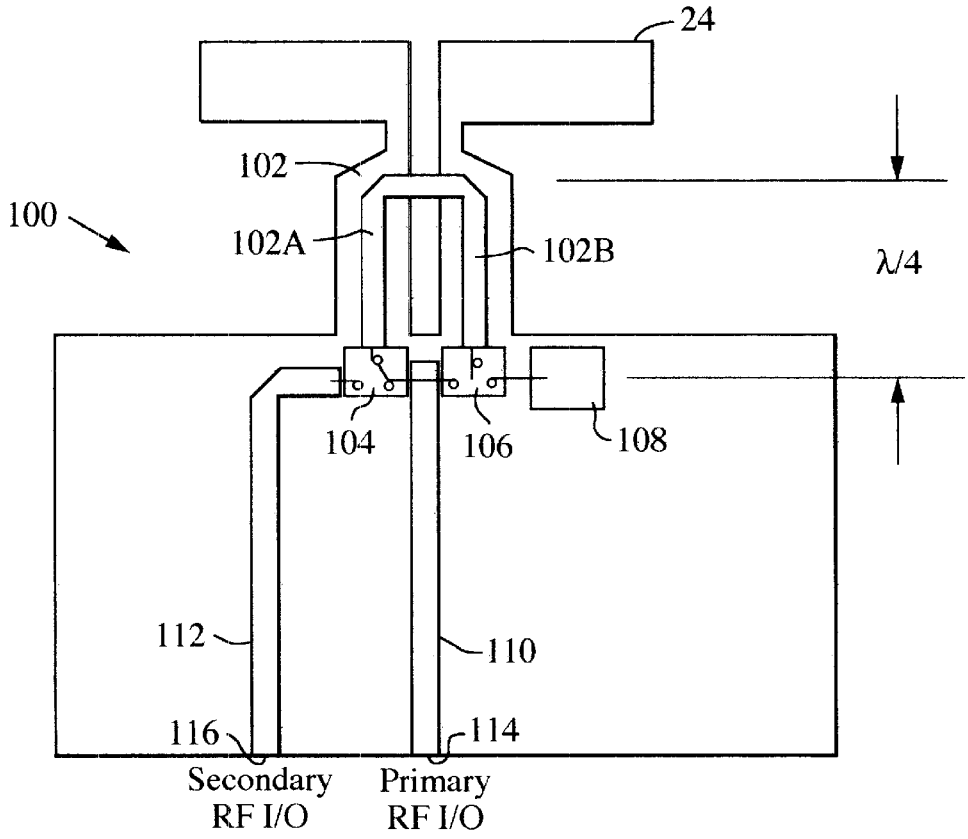
FIG. 7 is a further alternate embodiment, illustrating how two SP2T MEMS switches are implemented into a loop balun in place of the single SP2T switches shown in FIG. 6.

The use of single pole multi-throw MEMS switch junctions in a switch loop 180° phase bit radiator circuit as described above realizes new additional configurations and innovations. This is because of the RF characteristics exhibited by the metal-metal contact RF MEMS series switch. FIG. 7 is a simplified schematic diagram of another embodiment of a switch loop 180° phase bit radiator circuit 100, and illustrates how two SP2T MEMS switches 104, 106 are implemented into the loop balun 102 in place of the single SP2T switch 54 shown in FIG. 6. The balun 102 includes the microstrip loop formed by the conductor legs 102A, 102B and the transition segment 102C. Switch 104 is connected to an end of line 102A. Switch 106 is connected to an end of line 102B. Note the SP2T switch circuit is a 3 port device while the SPST is only a 2 port device. Having SP2T switches in the switch loop balun allow the addition of a matching load termination to one port of switch 106 and a secondary RF line 112 to one port of switch 110. Microstrip line 114 leads to the primary RF I/O port 114. Microstrip line 112 leads to a secondary RF I/O port 116. This circuit configuration realizes additional functionality to the switch loop balun with minimal bias complexity.

Figure 8A:
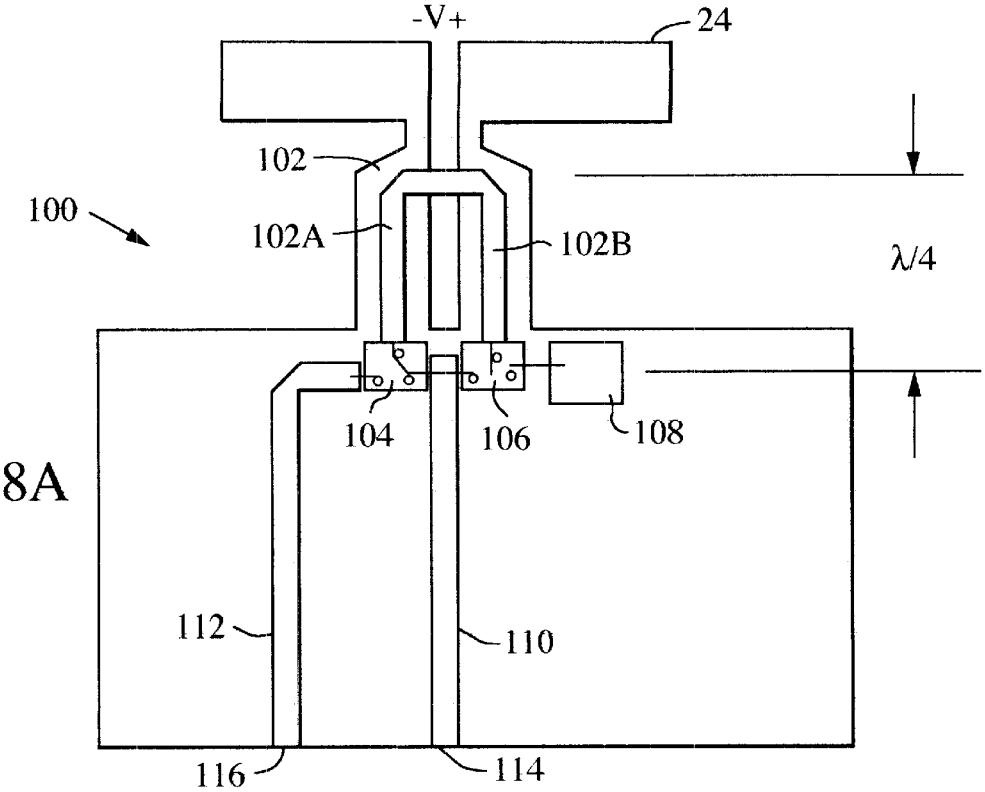
FIGS. 8A and 8B are schematic diagrams of the switch circuit of FIG. 7, illustrating how the circuit generates 180° phase shift by rerouting the RF signal around an loop transition or balun by two SP2TMEMS RF switches.
Figure 8B:
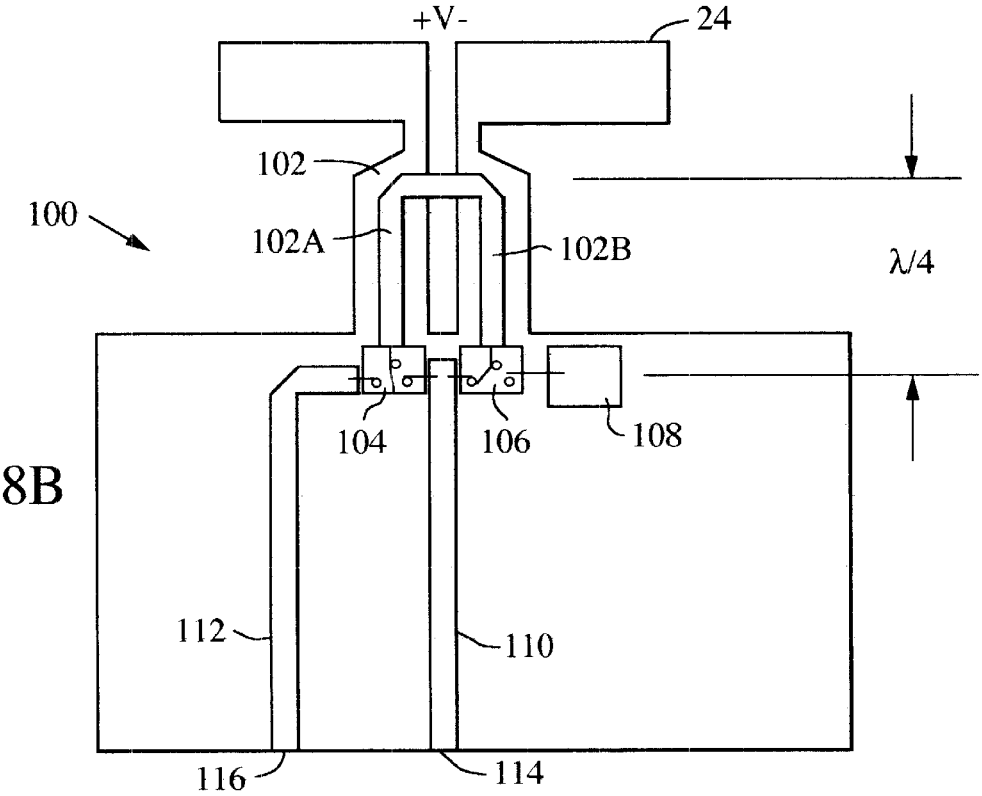

FIGS. 8A–8B illustrate two different phase states of the circuit 100. In one phase state (FIG. 8A), switch 104 is closed and is connecting the leg 102A of the loop balun to the primary transmission line 110. At the same time, the other switch 106 is open circuited to all of its three ports. This switch combination realizes a balun transition that excites a RF voltage potential across the two halves of the radiator 24.

In the other phase state (FIG. 8B), the switch 104 is open circuited to all of its three ports, while the other switch 106 is closed and is connecting the leg 102B of the loop balun to the primary transmission line 110. This switch combination also realizes a balun transition, with the exception that the excited RF voltage potential is 180 degree of phase with respect to the first phase state. Note the matching load termination 108 and secondary RF line 112 are isolated from the loop balun by the RF MEMS switches 104, 106. The function performed is similar to what is shown in FIG. 2, but with wider bandwidth.

Figure 9:
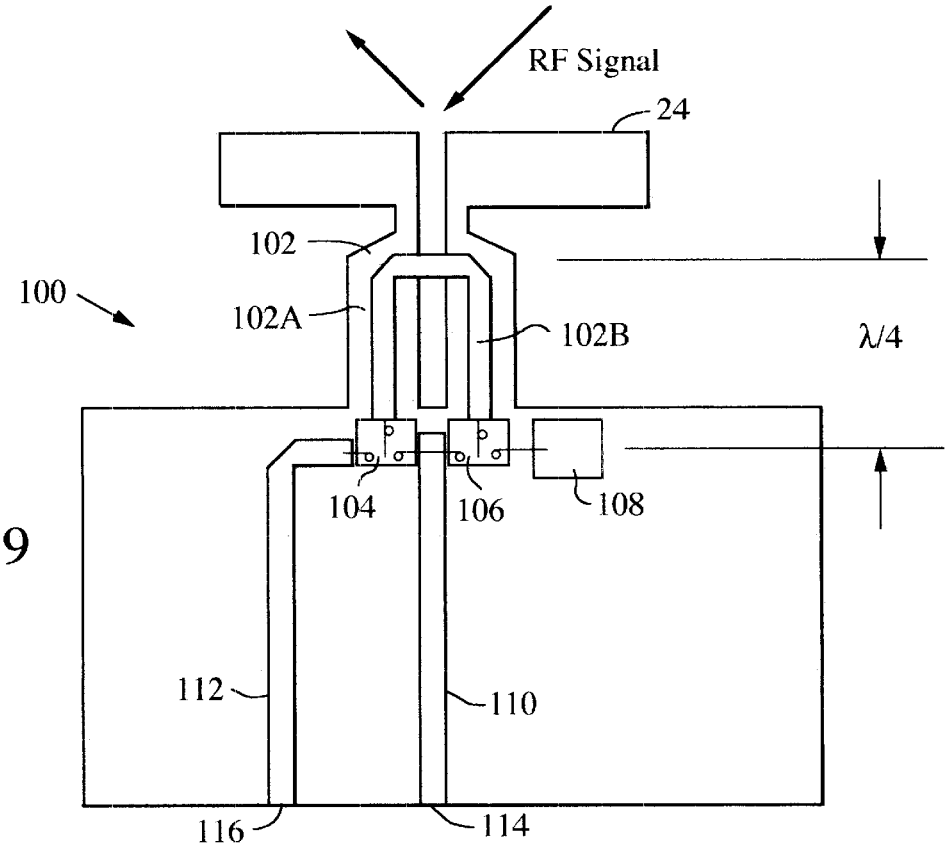
FIG. 9 illustrates the circuit of FIG. 7 with both MEMS RF switches in the open circuit condition to prevent RF energy from entering the radiator element.

When a switch loop 180° phase bit radiator circuit as described above are used behind the radiating elements of an antenna array, the circuit will also function as a reflective shutter by setting both switches to open circuits as shown in FIG. 9. As energy of an external RF signal enters the radiator, the open circuited switches appeared as short circuits (due to the quarter wavelength spacing of the open circuited MEMS switches from the balun) at the balun transition as shown in FIGS. 8A–8B. The external RF signal is then reflected back out the radiator. The function performed is also similar to what was shown in FIG. 3, but with wider bandwidth.

Figure 10:
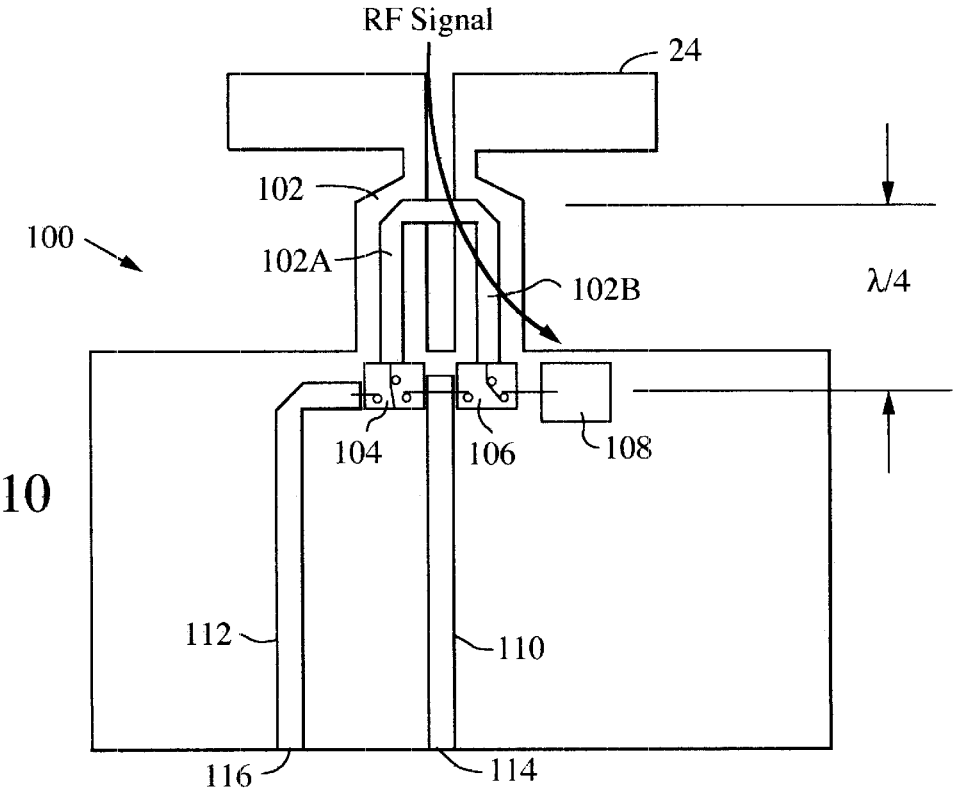
FIG. 10 illustrates the circuit of FIG. 7 with both MEMS RF switches in the open circuit condition to prevent RF energy from entering the radiator element.

An absorptive shutter is realized when switch 104 is open circuited and switch 106 is connected to the matching load termination 108. As shown in FIG. 10, energy of an external RF signal enters the radiator 24 and is routed to the load termination 108. The external RF signal is then absorbed by the load with little energy reflecting back out the radiator.

Figure 11A:
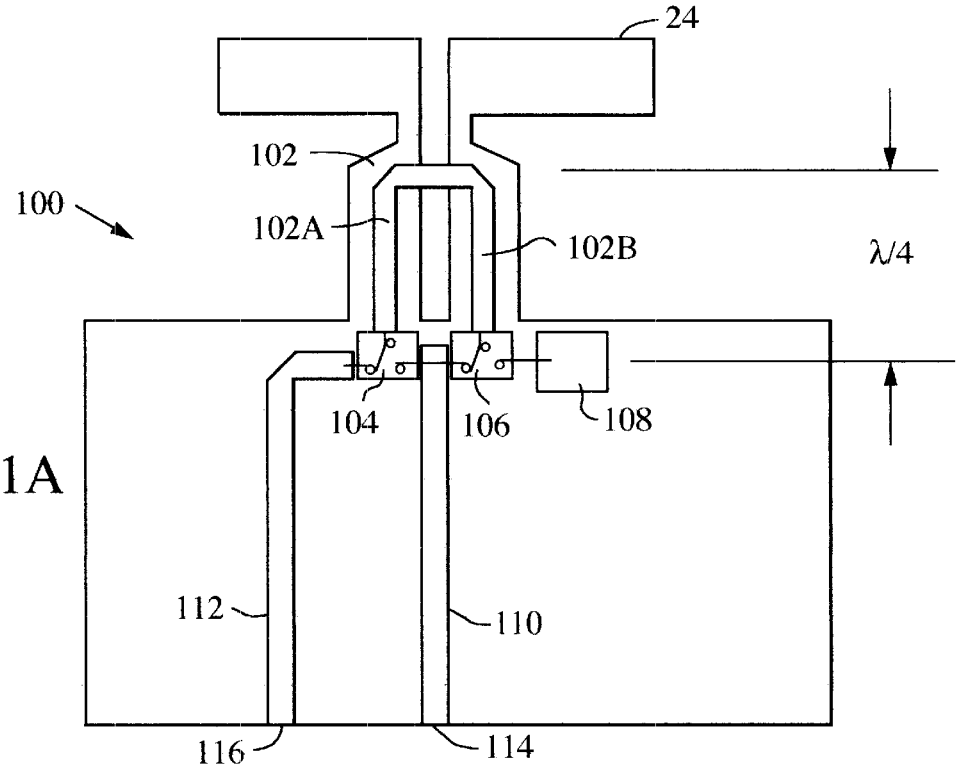
FIGS. 11A illustrates a switchable built in test (BIT) access path, realized when switch B is closed (FIG. 11A) and switch A is connected to the secondary RF line.
Figure 11B:
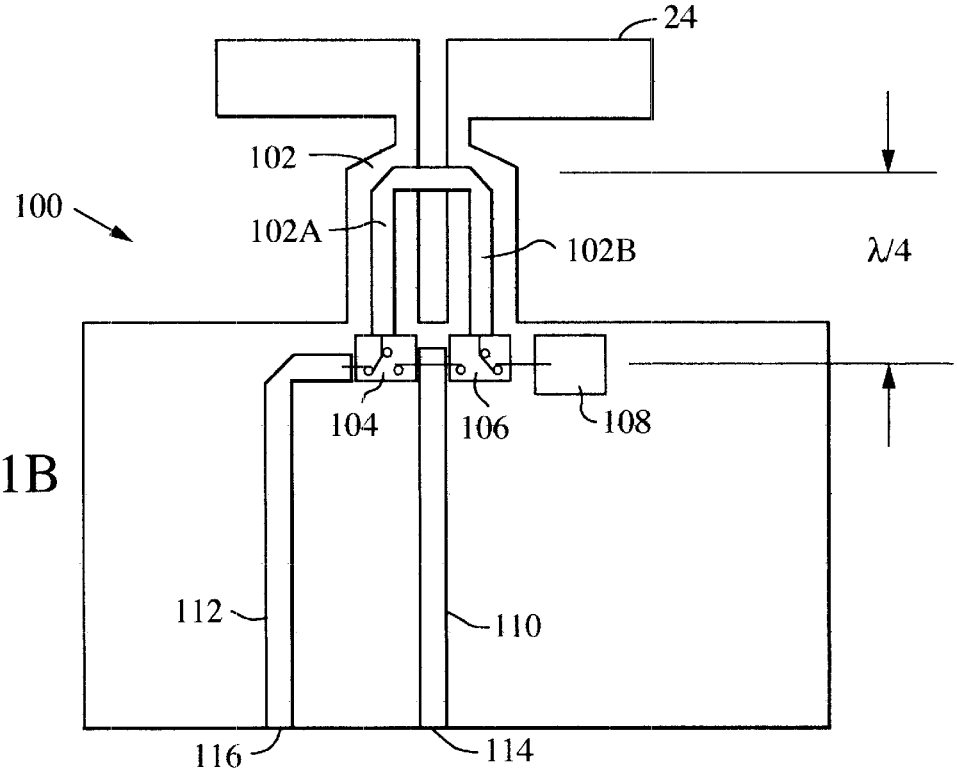
FIG. 11B shows that an RF signal transmitted to the secondary I/O ports can be coupled by the balun and routed back through the array receive path via the radiator's primary I/O ports.

A switchable built in test (BIT) access path is realized with the circuit 100 when switch 106 is closed (FIG. 11A) and switch 104 is connected to the secondary RF line 112. As shown in FIG. 11A, energy from the transmitted RF signal entering the radiator primary input/output (I/O) ports 114 of each radiator circuit can be coupled by the balun and routed through the secondary RF line 112 to the secondary I/O ports 116 for array calibration and health check. Likewise an RF signal transmitted to the secondary I/O ports of the radiator circuits can be coupled by the balun (FIG. 11B) and routed back through the array receive path via the microstrip transmission lines 110 and the radiator's primary I/O ports 114.

Figure 12:
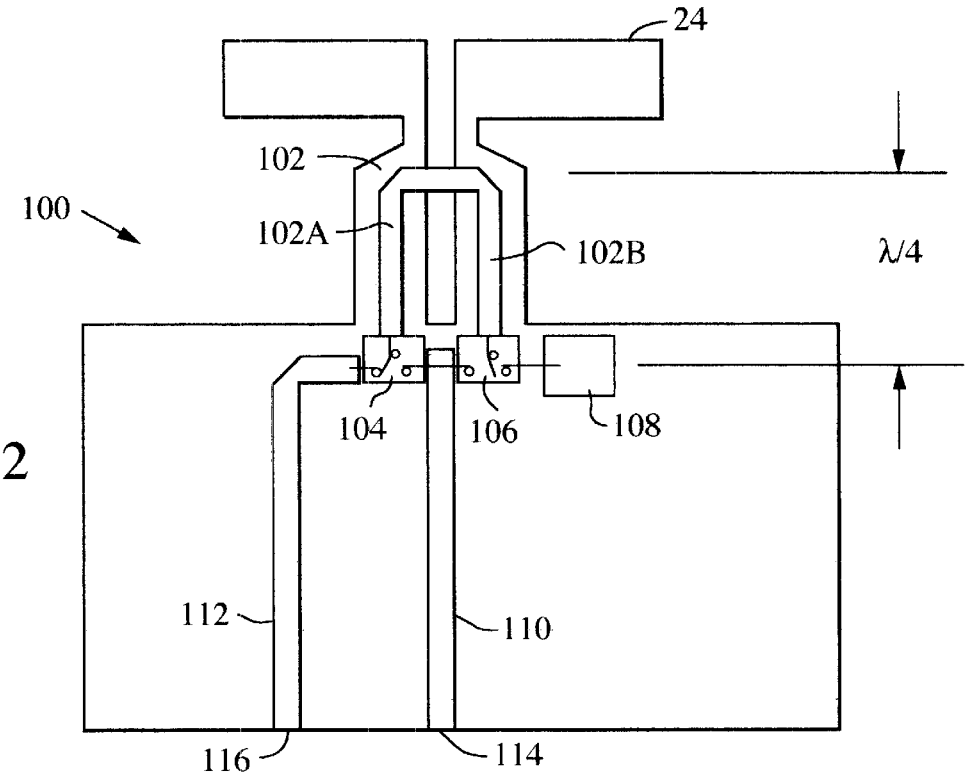
FIG. 12 is a schematic diagram illustrating realization of switchable apertures and BIT capabilities are realized.

Switchable apertures and BIT capabilities are realized when the circuit 100 is configured as shown in FIG. 12 within select groups of radiating elements behind an array. In FIG. 12, switch 106 is open circuited while switch 104 is connecting the secondary RF line 112 to the radiator 24 through the balun. RF signal is coupled by the balun from the radiator and routed through the secondary RF line 112 to the secondary RF I/O port 116 for array calibration and health check. Because of the characteristic of the MEMS metal-metal contact RF series switches, the primary RF line 110 is isolated from the radiator 24 with the switches in the states shown in FIG. 12. This will allow the capability to switch in or out portions of a main antenna array aperture to realize smaller separate independent apertures such as guards, line arrays and built-in test (BIT) and interferometer elements.

Figure 13:
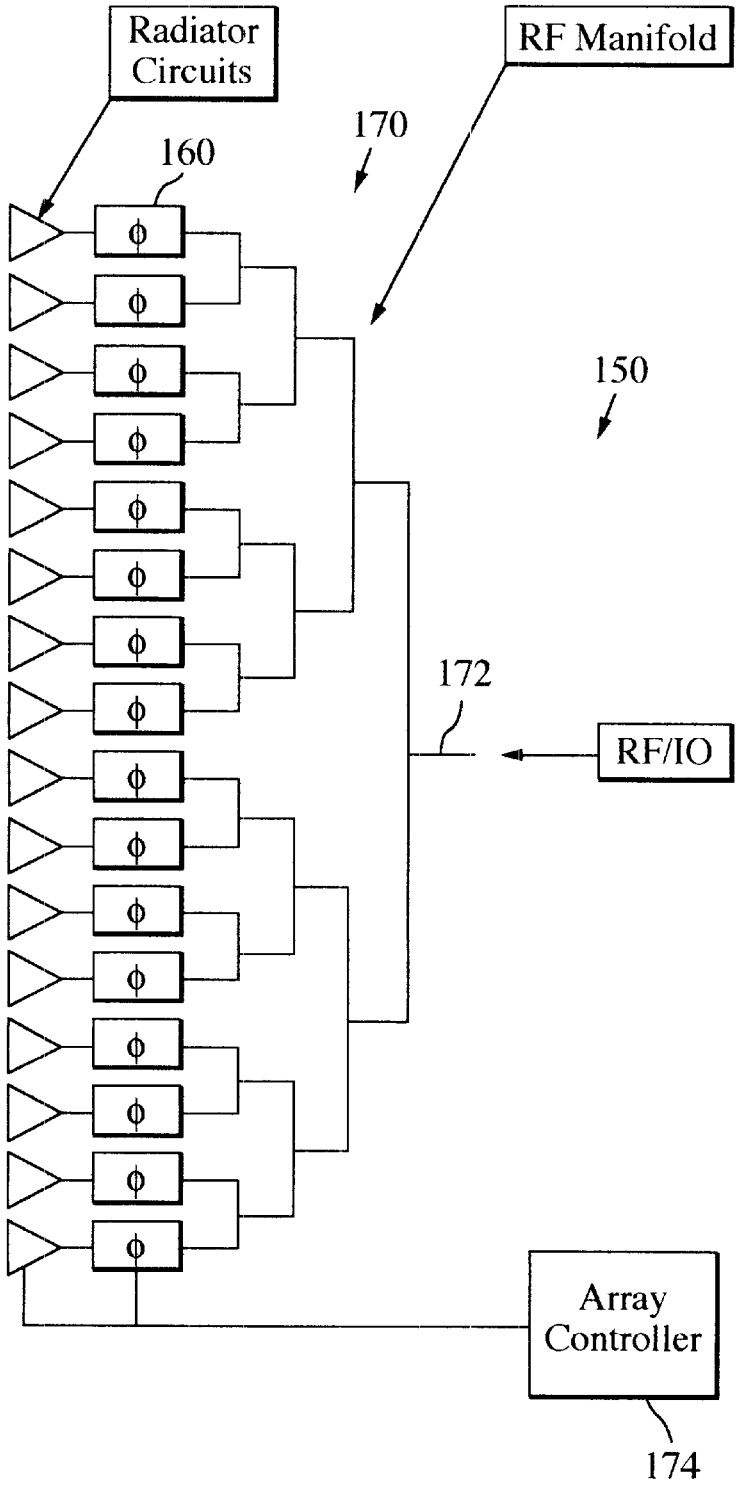
FIG. 13 is a simplified schematic diagram of an ESA antenna architecture employing switched loop radiator circuits in accordance with an aspect of the invention.

FIG. 13 is a simplified schematic diagram of an ESA antenna architecture 150 employing switched loop radiator circuits in accordance with an aspect of the invention. The ESA in this embodiment is a one dimensional linear array of radiator circuits, which can be any of the circuits 20, 50 or 100 as described above. Each of the radiator circuits is connected to a corresponding phase shifter MEMS phase shifter 160 comprising a linear array of phase shifters. In this embodiment, a 180° phase bit section, ordinarily incorporated in the phase shifter, is instead incorporated into the radiator circuit. This simplifies the phase shifters 160. The use of a linear array of the phase shifters reduces the number of transmit/receive (T/R) modules for the ESA. An RF manifold 170 combines the phase shifter RF ports into an ESA RF port. An array controller 174 provides control signals to the phase shifters 160 which controls the respective phase settings of the phase shifters 160 to achieve the desired ESA beam direction. The controller 174 also provides control signals to the radiator circuits to set the radiator circuit switches to the desired states for a given mode of operation.

The array 150 can include a single T/R module connected at the ESA RF port 172, or multiple T/R modules connected at junctions in the RF manifold. The array 150 in this embodiment is capable of reciprocal (transmit or receive) operation. Moreover, a plurality of the linear arrays 150 can be assembled together to provide a two dimensional array.

The ESA 150 provides capabilities in such applications as space-based radar and communication systems and X-band commercial aircraft situation awareness radar. Commercial automotive radar applications including adaptive cruise control, collision avoidance/warning and automated brake application will also benefit from the ESA because this technology is scalable to higher operational frequencies.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A switched loop RF radiator circuit, comprising:

a radiator element;

a circuit RF input/output (I/O) port;

a balun coupled between the radiator element and the I/O port, the balun including a 180° switched loop circuit having first and second transmission line legs coupled to a balun transition to provide a selectable 180° phase shift, and a microelectromechanically machined (MEM) switch circuit to select one of said transmission line legs, wherein said switch circuit includes first and second single-pole-single-throw (SPST) MEM switch circuits;

wherein a first pole of said first MEM switch circuit is connected to a first transmission line, a second pole of said first MEM switch circuit is connected to the first transmission line leg, a first pole of said second MEM switch is connected to a second transmission line, and a second pole of the second MEM switch circuit is connected to the second transmission line leg, the first and second transmission lines connected together at a junction and coupled to the I/O port;

wherein in a first circuit phase state, the first MEM switch is set to a closed state, and the second MEM switch is set to an open state, and in a second phase state mode the first MEM switch is set to an open state and the second MEM switch is set to a closed state to provide a 180° phase difference from the first phase state; and wherein in a reflective state, the first and second MEM switches are both set to the closed state to reflect incident RF energy.

2. The circuit of claim 1, wherein the first and second transmission line legs each have an effective electrical length of one quarter wavelength at an operating signal for the circuit.

3. The circuit of claim 1 wherein the radiator element is a dipole.

4. The circuit of claim 1, wherein the first and second transmission lines each have an effective electrical length of one half wavelength at an operating frequency.

5. The circuit of claim 2 wherein the switch circuit includes a single-pole-double-throw (SPDT) MEM switch circuit.

6. The circuit of claim 5, wherein a first pole of said SPDT MEM switch circuit is connected to the first transmission line leg, a second pole of the SPDT MEM switch circuit is connected to the second transmission line leg, and a third pole of the SPDT switch circuit is coupled to the I/O port.

7. The circuit of claim 6, wherein said SPDT MEM switch circuit has first, second and third switch states, said first state wherein said first pole is connected to said third pole and said second pole is isolated from said third pole, said second state wherein said second pole is connected to said third pole and said first pole is isolated from said third pole, and said third state wherein both said first pole and said second pole are isolated from the third pole.

8. The circuit of claim 1, further including:

a primary transmission line coupled between the MEM switch circuit and the RF I/O port;

a secondary transmission line coupled between the MEM switch circuit and a secondary RF I/O port;

the MEM switch circuit includes a first SPDT MEM switch circuit connected between said first transmission line leg, said primary transmission line and said secondary transmission line, and a second SPDT MEM switch circuit connected between said second transmission line leg, said primary transmission line and said secondary transmission line;

wherein the first SPDT switch circuit selectively connects the first transmission line leg to the primary transmission line or to the secondary transmission line, the first SPDT switch circuit further having an open circuit state, and the second SPDT switch circuit selectively connects the second transmission line leg to the primary transmission line or to a matched load termination, the second SPDT switch circuit further having an open circuit state.

9. The circuit of claim 1, wherein said MEM switch circuit comprises MEM metal-metal contact switches.

10. The circuit of claim 9, wherein said radiator element, said balun and said MEM switch circuit are all fabricated on a common dielectric substrate.

11. An electronically scanned array, comprising:

a linear array of radiator circuits, each circuit including a radiator element, a circuit RF input/output (I/O) port, a balun coupled between the radiator element and the I/O port, the balun including a 180° switched loop circuit having two transmission line legs coupled to a balun transition to provide a selectable 180° phase shift, and a microelectromechanically machined (MEM) switch circuit to select one of said transmission line legs, wherein for each radiator circuit, the switch circuit includes first and second single-pole-single-throw (SPST) MEM switch circuits, and wherein a first pole of said first MEM switch circuit is connected to a first transmission line, a second pole of said first MEM switch circuit is connected to the first transmission line leg, a first pole of said second MEM switch is connected to a second transmission line, and a second pole of the second MEM switch circuit is connected to the second transmission line leg, the first and second transmission liens connected together at a junction and coupled to the I/O port;

an array of phase shifters coupled to the I/O ports of the radiator circuits;

an RF manifold including a plurality of phase shifter ports respectively coupled to a corresponding phase shifter RF port and an RF port;

an array controller for providing control signals to the phase shifters to control the phase shift setting of the array of the phase shifters and to the MEM switch circuits;

wherein in a first array phase state, for each radiator circuit, the first MEM switch is set to a closed state, and the second MEM switch is set to an open state, and in a second phase state mode the first MEM switch is set to an open state and the second MEM switch is set to a closed state to provide a 180° phase difference from the first phase state; and wherein in a reflective state, the first and second MEM switches of each radiator circuit are both set to the closed state to reflect incident RF energy.

12. The array of claim 11, wherein said MEM switch circuit comprises MEM metal-metal contact switches.

13. The array of claim 12, wherein, for each radiator circuit, said radiator element, said balun and said MEM switch circuit are all fabricated on a common dielectric substrate.

14. The array of claim 11 wherein, for each radiator circuit, the switch circuit includes a single-pole-double-throw (SPDT) MEM switch circuit, and wherein a first pole of said SPDT MEM switch circuit is connected to the first transmission line leg, a second pole of the SPDT MEM switch circuit is connected to the second transmission line leg, and a third pole of the SPDT switch circuit is coupled to the I/O port.

15. The array of claim 11, wherein said SPDT MEM switch circuit has first, second and third switch states, said first state wherein said first pole is connected to said third pole and said second pole is isolated from said third pole, said second state wherein said second pole is connected to said third pole and said first pole is isolated from said third pole, and said third state wherein both said first pole and said second pole are isolated from the third pole.

16. The array of claim 11, further including, for each radiator circuit:

a primary transmission line coupled between the MEM switch circuit and the RF I/O port;

a secondary transmission line coupled between the MEM switch circuit and a secondary RF I/O port;

the MEM switch circuit includes a first SPDT MEM switch circuit connected between said first transmission line leg, said primary transmission line and said secondary transmission line, and a second SPDT MEM switch circuit connected between said second transmission line leg, said primary transmission line and said secondary transmission line;

wherein the first SPDT switch circuit selectively connects the first transmission line leg to the primary transmission line or to the secondary transmission line, the first SPDT switch circuit further having an open circuit state, and the second SPDT switch circuit selectively connects the second transmission line leg to the primary transmission line or to a matched load termination, the second SPDT switch circuit further having an open circuit state.

17. A switched loop RF radiator circuit, comprising:

a radiator element;

a circuit RF input/output (I/O) port;

a balun coupled between the radiator element and the I/O port, the balun including a 180° switched loop circuit having first and second transmission line legs coupled to a balun transition to provide a selectable 180° phase shift, and a microelectromechanically machined (MEM) switch circuit to select one of said transmission line legs, wherein the first and second transmission line legs each have an effective electrical length of one quarter wavelength at an operating signal for the circuit and wherein the switch circuit includes a single-pole-double-throw (SPDT) MEM switch circuit;

wherein a first pole of said SPDT MEM switch circuit is connected to the first transmission line leg, a second pole of the SPDT MEM switch circuit is connected to the second transmission line leg, and a third pole of the SPDT switch circuit is coupled to the I/O port; and wherein said SPDT MEM switch circuit has first, second and third switch states, said first state wherein said first pole is connected to said third pole and said second pole is isolated from said third pole, said second state wherein said second pole is connected to said third pole and said first pole is isolated from said third pole, and said third state wherein both said first pole and said second pole are isolated from the third pole.

18. The circuit of claim 17, wherein the radiator element is a dipole.

19. A switched loop RF radiator circuit, comprising:

a radiator element;

a circuit RF input/output (I/O) port;

a balun coupled between the radiator element and the I/O port, the balun including a 180° switched loop circuit having first and second transmission line legs coupled to a balun transition to provide a selectable 180° phase shift, and a microelectromechanically machined (MEM) switch circuit to select one of said transmission line legs;

a primary transmission line coupled between the MEM switch circuit and the RF I/O port;

a secondary transmission line coupled between the MEM switch circuit and a secondary RF I/O port; and the MEM switch circuit includes a first SPDT MEM switch circuit connected between said first transmission line leg, said primary transmission line and said secondary transmission line, and a second SPDT MEM switch circuit connected between said second transmission line leg, said primary transmission line and said secondary transmission line;

wherein the first SPDT switch circuit selectively connects the first transmission line leg to the primary transmission line or to the secondary transmission line, the first SPDT switch circuit further having an open circuit state, and the second SPDT switch circuit selectively connects the second transmission line leg to the primary transmission line or to a matched load termination, the second SPDT switch circuit further having an open circuit state.

20. An electronically scanned array, comprising:

a linear array of radiator circuits, each circuit including a radiator element, a circuit RF input/output (I/O) port, a balun coupled between the radiator element and the I/O port, the balun including a 180° switched loop circuit having two transmission line legs coupled to a balun transition to provide a selectable 180° phase shift, and a microelectromechanically machined (MEM) switch circuit to select one of said transmission line legs;

an array of phase shifters coupled to the I/O ports of the radiator circuits;

an RF manifold including a plurality of phase shifter ports respectively coupled to a corresponding phase shifter RF port and an RF port;

an array controller for providing control signals to the phase shifters to control the phase shift setting of the array of the phase shifters and to the MEM switch circuits;

a primary transmission line coupled between the MEM switch circuit and the RF I/O port;

a secondary transmission line coupled between the MEM switch circuit and a secondary RF I/O port; and the MEM switch circuit includes a first SPDT MEM switch circuit connected between said first transmission line leg, said primary transmission line and said secondary transmission line, and a second SPDT MEM switch circuit connected between said second transmission line leg, said primary transmission line and a said secondary transmission line;

wherein the first SPDT switch circuit selectively connects the first transmission line leg to the primary transmission line or to the secondary transmission line, the first SPDT switch circuit further having an open circuit state, and the second SPDT switch circuit selectively connects the second transmission line leg to the primary transmission line or to a matched load termination, the second SPDT switch circuit further having an open circuit state.

* * * * *

UNITED STATES PATENT AND TRADEMARK OFFICE

CERTIFICATE OF CORRECTION

PATENT NO. : 6,674,340 B2
DATED : January 6, 2004
INVENTOR(S) : Clifton Quan and Brian M. Pierce It is certified that error appears in the above-identified patent and that said Letters Patent is hereby corrected as shown below:

Column 1,
Line 2, "F33615-99-1473" should read -- F33615-99-2-1473. --

Signed and Sealed this

Fourteenth Day of September, 2004

JON W. DUDAS
*Director of the United States Patent and Trademark Office*